United States Patent [19]

Toyama et al.

[11] 4,224,909

[45] Sep. 30, 1980

[54] EXHAUST GAS RECIRCULATION SYSTEM FOR AN INTERNAL COMBUSTION ENGINE

[75] Inventors: Noboru Toyama; Tatsuya Taifu, both of Susono, Japan

[73] Assignee: Toyota Jidosha Kogyo Kabushiki Kaisha, Toyota, Japan

[21] Appl. No.: 7,601

[22] Filed: Jan. 29, 1979

[30] Foreign Application Priority Data

May 31, 1978 [JP] Japan ..... 53/75079[U]

[51] Int. Cl.[2] ..... F02M 25/06

[52] U.S. Cl. ..... 123/568

[58] Field of Search ..... 123/119 A

[56] References Cited

U.S. PATENT DOCUMENTS

| | | | |
|---|---|---|---|
| 4,092,960 | 6/1978 | Nohira et al. | 123/119 A |
| 4,109,624 | 8/1978 | Washio et al. | 123/119 A |
| 4,128,089 | 12/1978 | Takimoto et al. | 123/119 A |
| 4,137,874 | 2/1979 | Otsubo et al. | 123/119 A |
| 4,142,491 | 3/1979 | Hibino et al. | 123/119 A |
| 4,142,496 | 3/1979 | Saito et al. | 123/119 A |
| 4,151,819 | 5/1979 | Inada et al. | 123/119 A |
| 4,164,918 | 8/1979 | Haka | 123/119 A |
| 4,173,955 | 11/1979 | Yamada et al. | 123/119 A |

*Primary Examiner*—Wendell E. Burns

*Attorney, Agent, or Firm*—Finnegan, Henderson, Farabow, Garrett & Dunner

[57] ABSTRACT

In an exhaust gas recirculation system for an internal combustion engine of the back pressure control type which provides, by a vacuum-operated control valve, a pressure chamber of substantially constant and nearly atmospheric pressure at a middle portion of an exhaust gas recirculation passage, a thermostatic control means is incorporated in a vacuum passage which supplies control vacuum to the vacuum-operated control valve so as to modify the vacuum conducted therethrough in accordance with the temperature of the engine so that a partial ratio of exhaust gas recirculation is effected in cold operation of the engine.

4 Claims, 2 Drawing Figures

EXHAUST GAS RECIRCULATION SYSTEM FOR AN INTERNAL COMBUSTION ENGINE

BACKGROUND OF THE INVENTION

The present invention relates to an exhaust gas recirculation (EGR) system for an internal combustion engine for use with vehicles such as automobiles.

In conventional exhaust gas recirculation systems for internal combustion engines for use with vehicles such as automobiles, when the engine is operated in the cold state, exhaust gas recirculation is stopped in order to avoid deterioration of the operating performance of the engine. However, if exhaust gas recirculation is completely stopped it is very difficult to lower the NOx concentration in the exhaust gases, while on the other hand if exhaust gas recirculation is performed in cold operation in the same manner as in warmed-up operation, performance and flexibility of the engine are seriously deteriorated. Therefore, it is contemplated to make a compromise between these conditions and to perform exhaust gas recirculation at a moderate ratio in cold state operation so as not substantially to deteriorate the operating performance and yet substantially to lower the NOx concentration in the exhaust.

SUMMARY OF THE INVENTION

It is therefore the object of the present invention to provide an exhaust gas recirculation system for an internal combustion engine which performs exhaust gas recirculation even in cold operation of the engine, at a moderate ratio, and particularly such an exhaust gas recirculation system which operates depending upon the principle of back pressure control.

In accordance with the present invention, the above-mentioned object is accomplished by an exhaust gas recirculation system for an internal combustion engine having an intake passage, a throttle valve provided in said intake passage, and an exhaust passage, comprising: an exhaust gas recirculation passage for conducting exhaust gases from said exhaust passage to said intake passage; an exhaust gas recirculation control valve provided at a middle portion of said exhaust gas recirculation passage and having a diaphragm chamber and adapted to increase its opening as vacuum supplied to said diaphragm chamber increases; a vacuum passage which supplies vacuum to said diaphragm chamber; an orifice means provided at a middle portion of said exhaust gas recirculation passage on the upstream side of said exhaust gas recirculation control valve as seen in the direction of exhaust gas recirculation through said exhaust gas recirculation passage and defining a pressure chamber between itself and said exhaust gas recirculation control valve; a vacuum control valve provided at a middle portion of said vacuum passage and comprising a housing having a release port, a diaphragm, a first diaphragm chamber provided on one side of said diaphragm and supplied with pressure of the exhaust gases existing in said pressure chamber, a second diaphragm chamber provided on the other side of said diaphragm and opened to the atmosphere through said release port, a valve port which opens said vacuum passage to said second diaphragm chamber, and a valve element supported by said diaphragm and adapted to close said valve port when the pressure in said first diaphragm chamber is higher than that in said second diaphragm chamber by more than a predetermined amount, and to open said valve port in other pressure conditions; and a thermostatic control means which varies the opening area of said release port in accordance with the temperature of the engine.

An exhaust gas recirculation system of the back pressure control type comprises an exhaust gas recirculation passage for conducting exhaust gases from an exhaust passage of an engine to an intake passage thereof, an exhaust gas recirculation control valve provided at a middle portion of said exhaust gas recirculation passage and having a diaphragm chamber and adapted to increase its opening as vacuum supplied to said diaphragm chamber increases, a vacuum passage which supplies vacuum to said diaphragm chamber, an orifice means provided at a middle portion of said exhaust gas recirculation passage on the upstream side of said exhaust gas recirculation control valve as seen in the direction of exhaust gas recirculation through said exhaust gas recirculation passage and defining a pressure chamber between itself and said exhaust gas recirculation control valve, and a vacuum control valve provided at a middle portion of said vacuum passage and adapted to modify the vacuum supplied to said diaphragm chamber of said exhaust gas recirculation control valve in accordance with the pressure in said pressure chamber so as to maintain the pressure in said pressure chamber substantially at atmospheric level. By this arrangement, the pressure drop across said orifice means is maintained to be substantially the same as the pressure drop across the exhaust system of the engine, whereby it is guaranteed that the ratio of exhaust gas recirculation is maintained at substantially the same value under all operating conditions, the ratio being determined by the opening area of said orifice means.

In this case, the mass flow of exhaust gas recirculation Ge is expressed by the following formula:

$$Ge = C\,Ao\sqrt{(2g/w)\,|Pe-Pc|} \qquad (1)$$

wherein:

C is the flow coefficient of the orifice means;

Ao is the opening area of the orifice means;

W is the specific weight of air;

Pe is the pressure in the exhaust passage;

and Pc is the pressure in the pressure chamber.

The pressure Pc in the pressure chamber is determined by the balance of pressures in the vacuum control valve, which is expressed as follows:

$$Ad\ Pd + F = Ad\ Pc$$

wherein:

Ad is the effective diaphragm area of the vacuum control valve;

Pd is the pressure in the second diaphragm chamber; and

F is the spring force which biases the diaphragm in the valve opening direction.

The pressure Pd in the second diaphragm chamber is generally lower than atmospheric pressure, i.e. a partial vacuum, and gradually approaches atmospheric pressure as the opening area of the release port increases. Therefore, the pressure Pc in the pressure chamber increases, so as to reduce the pressure difference between the exhaust gas pressure Pe in the exhaust passage and the pressure Pc in the pressure chamber, thereby reducing the mass flow of exhaust gas recirculation Ge. Therefore, when the opening area of the release port is controlled by a thermostat valve so as to vary in accordance with the temperature of the engine, the ratio of exhaust gas recirculation is changed in accordance with the temperature of the engine so that the exhaust gas recirculation system, if properly designed, can perform exhaust gas recirculation at a moderate ratio even in cold state operation of the engine.

In accordance with a particular embodiment of the present invention, the release port may be formed as a plurality of parallel ports, one of which is opened or closed by a thermostat valve which responds to engine temperature.

BRIEF DESCRIPTION OF THE DRAWING

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

Figure 1:
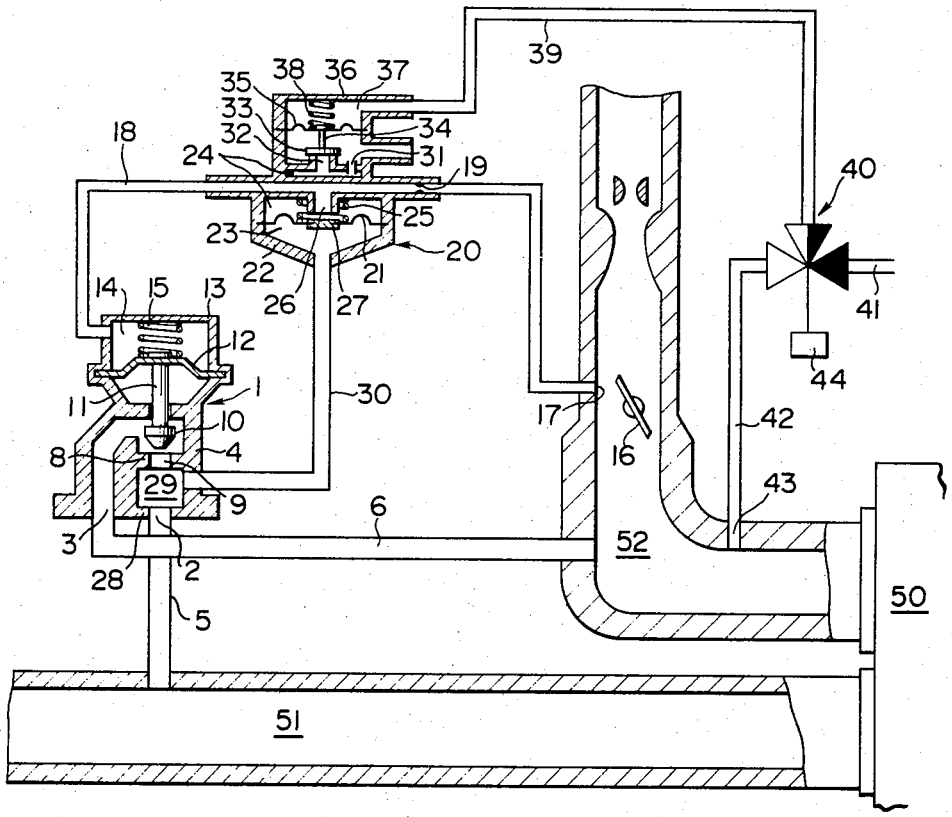
FIG. 1 is a diagrammatical illustration of an embodiment of the exhaust gas recirculation system according to the present invention.

Referring now to FIG. 1, an exhaust gas recirculation control valve generally designated by 1 comprises a valve housing 4 having an inlet port 2 which receives exhaust gases for recirculation from the exhaust passage 51 of an internal combustion engine 50 through a passage 5, and an outlet port 3 from which is discharged the exhaust gases for recirculation toward the intake passage 52 of the engine through a passage 6. The valve housing 4 further comprises a valve seat 8 which defines a valve port 9 between the inlet port 2 and the outlet port 3. The valve port 9 is opened or closed by a valve element 10, which is supported by a stem or valve rod 11, which in turn is drivingly supported by a diaphragm 12. Above the diaphragm 12 as seen in the figure is defined a diaphragm chamber 14 by the cooperation of the diaphragm 12 and a cover 13. A compression coil spring 15 is provided in the diaphragm chamber 14 so as to exert a downward spring force (as viewed in the figure) on the diaphragm 12, so that the valve element 10 is driven toward the valve seat 8 so as to close the valve port 9 by the spring force of the spring 15. The diaphragm chamber 14 is connected, by way of a vacuum passage 18, with a first vacuum port 17 provided in the intake passage 52, said vacuum port being located upstream of a throttle valve 16 incorporated in the intake passage 52 when the throttle valve is fully closed, while it is located downstream of the throttle valve when it is opened beyond a predetermined opening.

At a middle portion of the vacuum passage 18 is provided a throttling means 19, and a vacuum control valve 20 is also provided which controls the vacuum conducted through the vacuum passage 18 from the vacuum port 17 to the diaphragm chamber 14 of the exhaust gas recirculation control valve 1. The vacuum control valve 20 incorporates a housing 22 and a diaphragm 21, and first and second diaphragm chambers 23 and 24 are defined below and above the diaphragm, respectively, as seen in the figure. The diaphragm 21 is biased downward by a compression coil spring 25. The vacuum control valve 20 also has a port 26 which opens in the second diaphragm chamber 24 and serves to communicate the vacuum passage 18 with the chamber 24. The port 26 is opened or closed by a valve element 27 which is supported and driven by the diaphragm 21. The diaphragm 21 moves upward as seen in the figure so as to shift the valve element 27 against the spring force of the compression coil spring 25 and so as to close the port 26, when the pressure level in the first diaphragm chamber 23 is higher than that in the second diaphragm chamber 24 by more than a predetermined value, while on the other hand it moves downward as seen in the figure by the biasing force of the compression coil spring 25, so as to shift the valve element 27 away from the port 26 and so as to open the port, in other pressure conditions. The first diaphragm chamber 23 is connected, by means of a passage 30, with a back pressure chamber 29 defined between the valve seat 8 and an orifice means 28 provided upstream of the valve port 9 of the exhaust gas recirculation valve 1, so that the diaphragm chamber 23 is supplied with the pressure in the back pressure chamber 29. The second diaphragm chamber 24 is open to the atmosphere through first and second release ports 31 and 32 provided in parallel to each other. The first release port 31 is constantly open, while the second release port 32 is selectively opened or closed by a valve element 33, which is supported by a diaphragm 35 by way of a stem 34. The valve element 33 is shifted downward as seen in the figure by the biasing force of a compression coil spring 38 so as to close the second release port 32, when the vacuum in a diaphragm chamber 37 is not higher than a predetermined level, while it is shifted upward as seen in the figure by the diaphragm 25 against the biasing force of the compression coil spring 38, when the vacuum in the diaphragm chamber 37 is at or higher than the predetermined level. The diaphragm chamber 37 defined by co-operation of the diaphragm 35 and a housing 36 of the vacuum control valve 20 is connected, by means of a passage 39, to an electromagnetic transfer valve 40, which, when energized, communicates the diaphragm chamber 37 with a release port 41, and which, when de-energized, communicates the diaphragm chamber 37 with a vacuum port 43 through a passage 42. The vacuum port 43 is provided in the intake passage 52 at a position which is downstream of the throttle valve 16, in all operating positions of the throttle valve 16. The electromagnetic transfer valve 40 is controlled by a thermoswitch 44 so that it is energized only when the temperature of the engine which incorporates the exhaust gas recirculation control valve of the present invention is higher than a predetermined level.

The exhaust gas recirculation system described above and shown in FIG. 1 operates as follows:

When the throttle valve 16 is not opened so much as to traverse the vacuum port 17, as in idling operation, no substantial vacuum is supplied to the port 17. Therefore, the exhaust gas recirculation control valve 1 is closed, and no exhaust gas recirculation is effected.

When the throttle valve 16 is opened beyond the vacuum port 17, as shown in FIG. 1, the vacuum port is supplied with substantial vacuum, which is conducted through the vacuum passage 18 to the diaphragm chamber 14 of the exhaust gas recirculation control valve 1. However, the vacuum which is actually supplied to the diaphragm chamber 14 is modified by the vacuum control valve 20. In this case, the vacuum modification by the vacuum control valve 20 is so effected that the pressure in the back pressure chamber 29 is maintained substantially at a constant level in accordance with balance of pressures between the first and second diaphragm chambers in the vacuum control valve 20. Therefore, the ratio of exhaust gas recirculation from the exhaust passage 51 to the intake passage 52, determined by the difference between the pressure in the exhaust passage 51 and the pressure in the back pressure chamber 29 which is close to atmospheric pressure, is automatically controlled to be substantially constant, regardless of the flow rate of exhaust gases in the exhaust passage, i.e. the power output of the engine. In this case, when the engine is operating in the cold state, the diaphragm chamber 37 is connected to the vacuum port 43 through the electromagnetic transfer valve 40, and therefore the diaphragm 35 is moved upwards as seen in the figure so as to open the second release port 32. As a result, the pressure in the second diaphragm chamber 24 of the vacuum control valve 20 becomes higher than that which would dominate the same chamber in warmed-up operation of the engine, in which the second release port 32 is closed, and the chamber 24 is opened to the atmosphere only through the first release port 31. As a result, a higher pressure is maintained in the back pressure chamber 29, so as to provide a reduced pressure difference across the orifice means 28 and, accordingly, a lower ratio of exhaust gas recirculation in cold operation of the engine. By effecting exhaust gas recirculation even in cold operation of the engine at a lower ratio as described above, the NOx level in the exhaust gases is reduced in cold operation of the engine without substantially deteriorating the operational performance of the engine.

Although in the embodiment described hereinabove the second release port 32 is adapted to be opened or closed by a diaphragm-operated valve means, a modification may be incorporated so that the opening area of a release port is continuously increased or decreased by a thermosensitive valve means such as a thermowax type valve means. Further, a thermosensitive valve means may be directly provided in the passage 18 so as to interrupt the passage 18, so that exhaust gas recirculation is stopped when temperature of the engine is extremely low.

Figure 2:
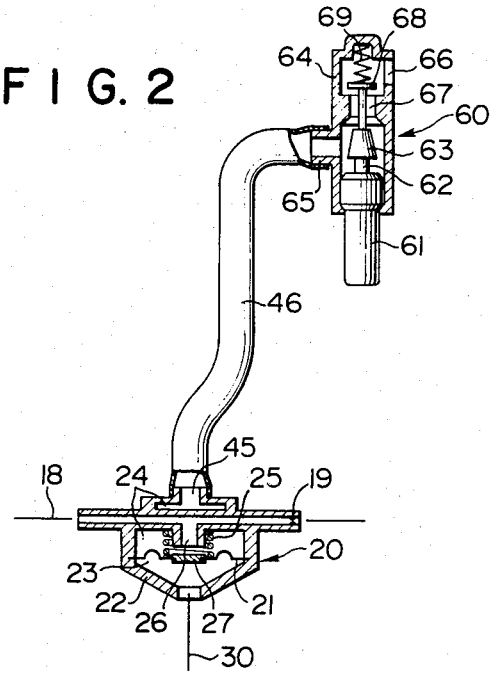
FIG. 2 is a diagrammatical view showing an essential part of another embodiment of the present invention.

FIG. 2 is a diagrammatical sectional view of an essential portion of another embodiment of the exhaust gas recirculation system of the present invention. In FIG. 2 the portions corresponding to those shown in FIG. 1 are designated by the same reference numerals. In this second embodiment the vacuum control valve 20 has a single release port 45 which is connected with a thermostat valve 60 by way of a conduit 46, so that its effective opening is controlled. The thermostat valve 60 has a thermowax actuator 61 responsive to the temperature of the engine, detected as, for example, the temperature of cooling water, said actuator being adapted to drive a cone-shaped valve element 63 by way of an actuator rod 62. The valve element 63 co-operates with a valve port 67 formed between a connecting port 65 and a release port 66 formed in a valve housing 64 so as continuously to vary the effective opening are of the release port 45. The valve element 63 is positioned in the downward position as seen in the figure when the engine is in the cold state so as fully to open the valve port 67, and, as the engine is gradually warmed up, the valve element is gradually driven upward in the figure by the thermowax actuator 61 so as gradually to reduce the opening area of the valve port 67 until a minimum opening area is left for the valve port 67 when the engine has been completely warmed up. In this final state, a stopper 68 connected with the valve element 63 abuts against the inside wall of the housing 64, so that further upward movement of the valve element is prevented, thereby maintaining the aforementioned minimum opening of the valve port 67. When the temperature of the engine lowers, the valve element 63 is shifted downward in the figure by a biasing spring, so as to increase the opening area of the valve port 67. Thus, the ratio of exhaust gas recirculation is continuously varied in accordance with warming up of the engine.

Although the invention has been shown and described with respect to some preferred embodiments thereof, it should be understood by those skilled in the art that various changes and omissions of the form and detail thereof may be made therein without departing from the scope of the invention.

We claim:

1. An exhaust gas recirculation system for an internal combustion engine having an intake passage, a throttle valve provided in said intake passage, and an exhaust passage, comprising:

an exhaust gas recirculation passage for conducting exhaust gases from said exhaust passage to said intake passage;

an exhaust gas recirculation control valve provided at a middle portion of said exhaust gas recirculation passage and having a diaphragm chamber and adapted to increase its opening as vacuum supplied to said diaphragm chamber increases;

a vacuum passage which supplies vacuum to said diaphragm chamber;

an orifice means provided at a middle portion of said exhaust gas recirculation passage on the upstream side of said exhaust gas recirculation control valve as seen in the direction of exhaust gas recirculation through said exhaust gas recirculation passage and defining a pressure chamber between itself and said exhaust gas recirculation control valve;

a vacuum control valve provided at a middle portion of said vacuum passage and comprising a housing having a release port, a diaphragm, a first diaphragm chamber provided on one side of said diaphragm and supplied with pressure of the exhaust gases existing in said pressure chamber, a second diaphragm chamber provided on the other side of said diaphragm and opened to the atmosphere through said release port, a valve port which opens said vacuum passage to said second diaphragm chamber, and a valve element supported by said diaphragm and adapted to close said valve port when the pressure in said first diaphragm chamber is higher than that in said second diaphragm chamber by more than a predetermined amount, and to open said valve port in other pressure conditions;

and a thermostatic control means which varies the opening area of said release port in accordance with the temperature of the engine.

2. The system of claim 1, wherein said thermostatic control means comprises a diaphragm operated valve having a diaphragm chamber and adapted to alter the opening area of said release port in accordance with amount of vacuum supplied to said diaphragm chamber, and a thermostatic transfer valve which selectively supplies vacuum or atmospheric pressure to said diaphragm chamber of said diaphragm operated valve in accordance with the temperature of the engine.

3. The system of claim 2, wherein said release port is provided as a plurality of parallel ports, one of which is opened or closed by said diaphragm operated valve.

4. The system of claim 1, wherein said thermostatic control means is a thermostatic valve having a thermowax actuator responsive to the temperature of the engine, a valve element driven by said actuator, and a valve port of which the opening is continuously controlled by said valve element in accordance with thermal actuation of said thermowax actuator.

* * * * *